US010619313B2

(12) United States Patent
Fruehwirt

(10) Patent No.: US 10,619,313 B2
(45) Date of Patent: Apr. 14, 2020

(54) METHOD FOR DETERMINING VERTICAL AND LATERAL POSITION FAULTS OF A TRACK AND TRACK MAINTENANCE MACHINE

(71) Applicant: PLASSER & THEURER EXPORT VON BAHNBAUMSCHINEN GESELLSCHAFT M.B.H., Vienna (AT)

(72) Inventor: Leopold Fruehwirt, Pregarten (AT)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 250 days.

(21) Appl. No.: 15/567,255

(22) PCT Filed: May 17, 2016

(86) PCT No.: PCT/EP2016/000812

§ 371 (c)(1),
(2) Date: Oct. 27, 2017

(87) PCT Pub. No.: WO2016/202420

PCT Pub. Date: Dec. 22, 2016

(65) Prior Publication Data

US 2018/0106000 A1 Apr. 19, 2018

(30) Foreign Application Priority Data

Jun. 17, 2015 (AT) ..... 382/2015

(51) Int. Cl.
*E01B 35/08* (2006.01)
*E01B 35/06* (2006.01)
(Continued)

(52) U.S. Cl.
CPC ..... *E01B 35/08* (2013.01); *E01B 27/17* (2013.01); *E01B 35/06* (2013.01); *E01B 27/16* (2013.01); *E01B 35/04* (2013.01)

(58) Field of Classification Search
CPC ..... E01B 35/00; E01B 35/02; E01B 35/04; E01B 35/06; E01B 35/08; E01B 35/10
See application file for complete search history.

(56) References Cited

U.S. PATENT DOCUMENTS 3,547,039 A * 12/1970 Franz ..... E01B 31/08 104/8
3,664,265 A * 5/1972 Sauterel ..... E01B 33/02 104/8

(Continued)

FOREIGN PATENT DOCUMENTS

| | | |
|---|---|---|
| CH | 483520 | 2/1970 |
| DE | 10045468 A1 | 4/2002 |
| WO | 2015124253 A1 | 8/2015 |

*Primary Examiner* — Jason C Smith
(74) *Attorney, Agent, or Firm* — Laurence A. Greenberg; Werner H. Stemer; Ralph E. Locher

(57) ABSTRACT

A method for determining vertical and lateral position faults of a track employs a track position measuring system having a common reference base formed of a single measuring chord disposed centrally between the rails and extending in the longitudinal direction of the machine. Two sensors are disposed on a central track position measuring unit for determining a longitudinal height and for determining a versine. The sensors each contact the measuring chord. Each track position measuring unit has two laser scanners, which are associated with respective rails, for scanning in a y-axis extending normal to a longitudinal direction of the rails and in a z-axis extending in a vertical direction. A track maintenance machine for carrying out track position corrections is also provided. Thus, a simplification of the track position measuring system with increased accuracy can be achieved.

5 Claims, 3 Drawing Sheets

(51) Int. Cl.

| | |
|---|---|
| ***E01B 27/17*** | (2006.01) |
| ***E01B 27/16*** | (2006.01) |
| ***E01B 35/04*** | (2006.01) |

(56) References Cited

U.S. PATENT DOCUMENTS

| | | | | | |
|---|---|---|---|---|---|
| 3,799,058 | A * | 3/1974 | Plasser | E01B 27/17 | 104/7.1 |
| 3,864,039 | A * | 2/1975 | Wilmarth | B61K 9/08 | 356/625 |
| 4,165,693 | A * | 8/1979 | Theurer | E01B 27/025 | 104/12 |
| 6,804,621 | B1 * | 10/2004 | Pedanckar | E01B 37/00 | 702/85 |
| 2018/0106000 | A1 * | 4/2018 | Fruehwirt | E01B 27/17 | |
| 2019/0257038 | A1 * | 8/2019 | Wollanek | E01B 27/17 | |

* cited by examiner

Fig. 3
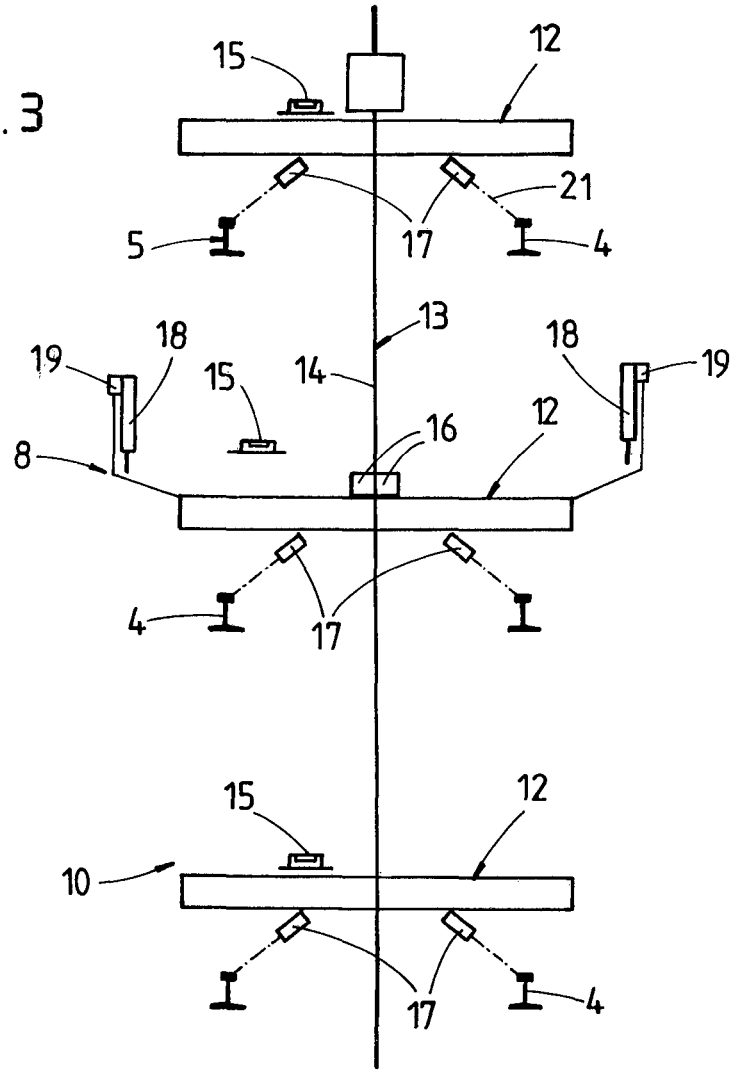
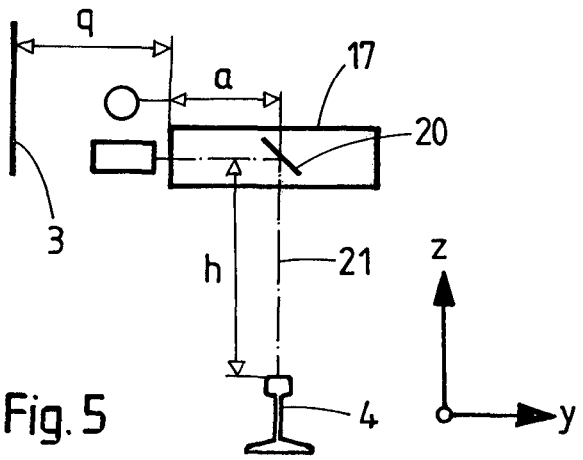
Fig. 5
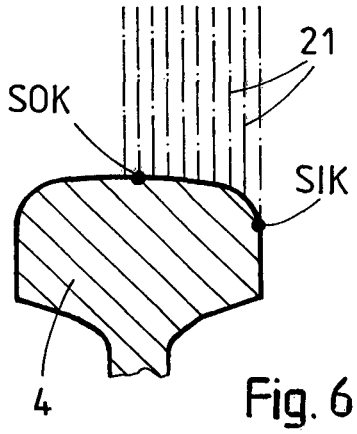
Fig. 6

METHOD FOR DETERMINING VERTICAL AND LATERAL POSITION FAULTS OF A TRACK AND TRACK MAINTENANCE MACHINE

BACKGROUND OF THE INVENTION

Field of the Invention

The invention relates to a method for determining vertical and lateral position faults of a track, wherein the track is scanned with the aid of track position measuring units following one another in a longitudinal direction of the track, while using a reference base connecting the track position measuring units to one another. The invention also relates to a track maintenance machine for carrying out track position corrections, including a machine frame which is mobile by on-track undercarriages on rails of a track and includes a track lifting and lining unit, a track position measuring system composed of track position measuring units following one another with regard to a longitudinal direction of the machine and each registering the track position, and a reference base common to the track position measuring units.

According to WO 2015/124253, a track measuring system for determining track position faults is already known, wherein the machine frame itself is used as reference base for the track position measuring units. These are likewise arranged on the machine frame and designed for non-contact scanning of the rails.

BRIEF SUMMARY OF THE INVENTION

It is the object of the present invention to create a method or a track maintenance machine of the kind mentioned at the beginning with which a simplification of the engineering effort can be achieved.

According to the invention, this object is achieved with a method in which both vertical as well as lateral position faults of the track are scanned on the track position measuring unit located centrally with regard to the longitudinal direction of the track, at a single measuring chord which is fixed to the two outer track position measuring units and forms the entire reference base. This object is also achieved with a track maintenance machine in which the common reference base is formed of a single measuring chord disposed centrally between the rails and extending in the longitudinal direction of the machine.

Due to the use of only a single measuring chord as reference base, a simplified design of the track position measuring units is possible since the hitherto known transferring of the vertical position faults onto two measuring chords, which are additionally placed in the upper region of the machine, is completely unnecessary. This also has the particular advantage that the free space, which was thus far required for the unhindered longitudinal guidance of the measuring chord over the entire length of the machine, is now available without hindrance for the structure of the machine. Also, using a single measuring chord guarantees a precise measurement independent of deflections or torsion of the machine frame.

Additional advantages of the invention become apparent from the further claims and the drawing description.

BRIEF DESCRIPTION OF THE SEVERAL VIEWS OF THE DRAWING

The invention will be described in more detail below with reference to embodiments represented in the drawing.

DESCRIPTION OF THE INVENTION

Figure 1:
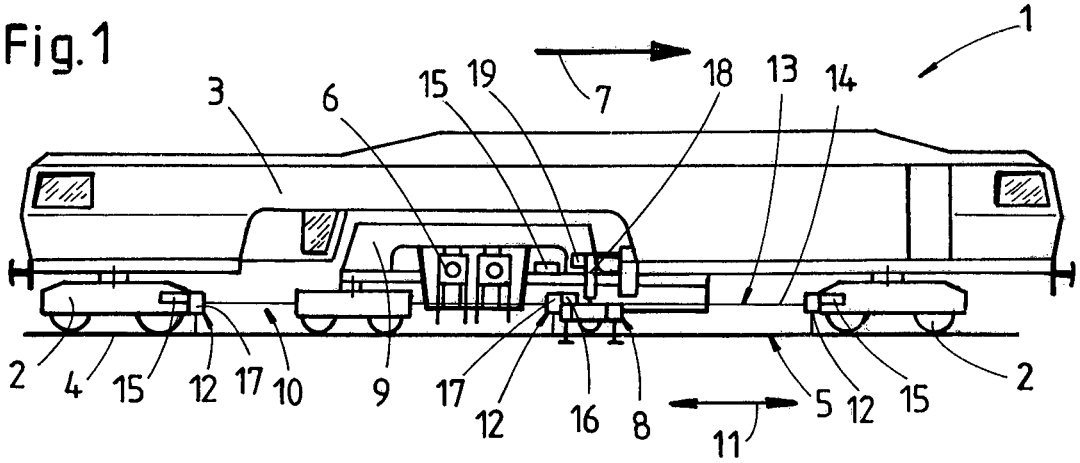
FIG. 1 shows a side view of a track maintenance machine, FIGS. 2 to 6 each show a schematic representation of a track position measuring system.

A track maintenance machine 1, shown in FIG. 1, for carrying out track position corrections has a machine frame 3 supported on on-track undercarriages 2 and is mobile on rails 4 of a track 5. A tamping unit 6 for tamping the track 5 is arranged between the two on-track undercarriages 2. The said tamping unit 6 and, immediately in front of the tamping unit 6 with regard to a working direction 7, a track lifting- and lining unit 8 are connected to a satellite frame 9 which is displaceable relative to the machine frame 3 in a longitudinal direction 11 of the machine.

Provided for determining track position faults is a track position measuring system 10 which is composed of three track position measuring units 12, arranged one following the other with regard to the longitudinal direction 11 of the machine and each registering the position of the rail 4, and a reference base 13 common for said units. The reference base 13 consists of a single measuring chord 14 arranged centrally between the rails 4 and extending in the longitudinal direction 11 of the machine.

Associated with each track position measuring unit 12 is an inclinometer 15 for registering a transverse level of the track 5. The track position measuring unit 12 located centrally with regard to the longitudinal direction 11 of the machine is fastened directly on the track lifting-lining unit 8, while the two track position measuring units 12 at the ends are arranged, together with the associated inclinometer 15, on the on-track undercarriage 2 in each case. The inclinometer 15 associated with the central track position measuring unit 12 is positioned on the satellite frame 9 (see FIG. 2).

Arranged on the central track position measuring unit 12 are two measuring transducers 16, each contacting the measuring chord 14, for detecting a longitudinal level (i.e. the difference between target position and actual position of the track in vertical direction) on the one hand and for detecting a versine (corresponds to the difference between target position and actual position of the track in horizontal direction) on the other hand.

Each of the three track position measuring units 12 has two laser scanners 17, associated with a rail 4 in each case, for scanning in a horizontal y-axis, extending perpendicularly to a longitudinal direction of the rail, and in a z-axis extending in vertical direction (see FIG. 5).

Figure 2:
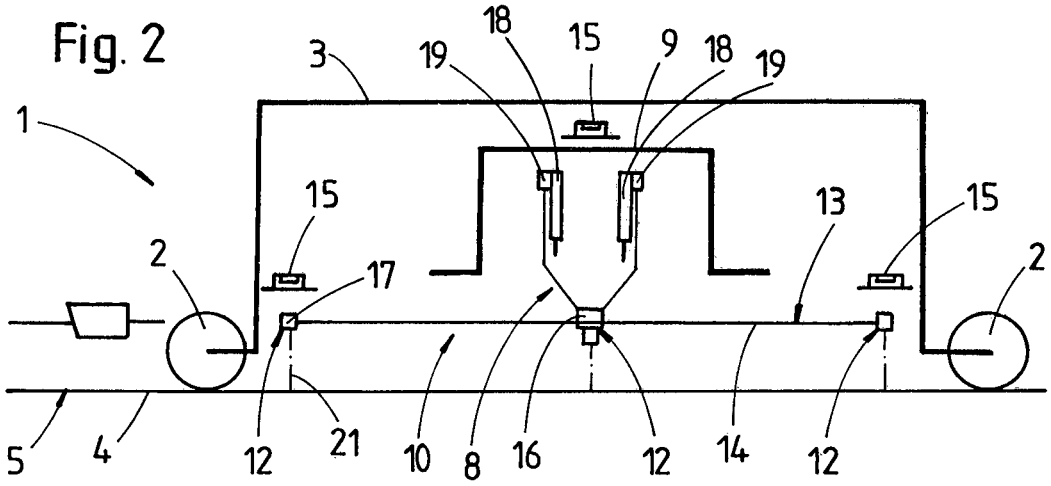

As shown schematically in FIGS. 2 and 3, each lifting drive 18, provided for the vertical adjustment of the track lifting-lining unit 8 and articulatedly connected to the satellite frame 9, is associated with a measuring transducer 19 for detecting a change in height caused by lifting of the track 5.

Figure 4:
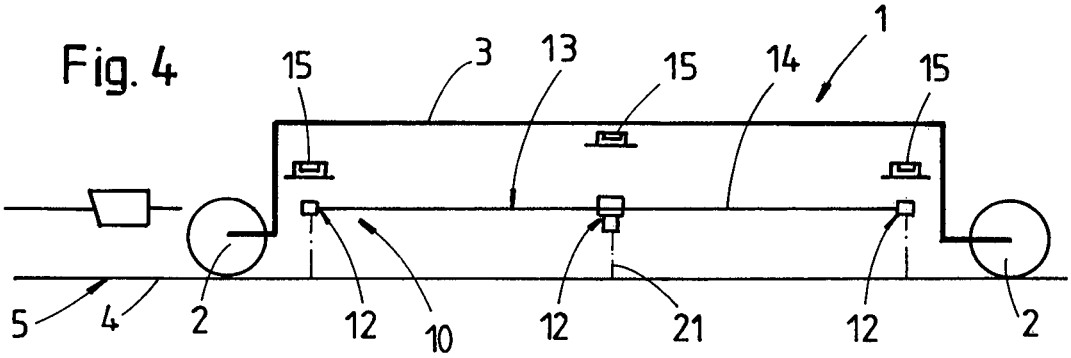

The schematic representation according to FIG. 4 refers to a known variant of a track maintenance- or tamping machine 1. On the latter, the tamping units and track lifting-lining units, not further shown, are fastened directly on the machine frame 3 for a step-wise forward working motion. In this variant, the two outer track position measuring units 12 are each arranged directly on the machine frame 3 in the vicinity of the on-track undercarriage 2. The central track position measuring unit 12, together with the associated inclinometer 15, is likewise connected to the machine frame 3 in the region of the track lifting-lining unit.

In FIG. 5, the laser scanner 17 displaceable relative to the machine frame 3 is shown on a larger scale. The laser scanner includes a mirror 20, moving back and forth in a transverse direction of the vehicle, for deflection of a laser beam 21. In this way, a cross-sectional profile of the rail 4 is traced in each case in connection with a multitude of laser beams 21 following one another (see FIG. 6).

With this scanning movement in the horizontal y-axis, extending perpendicularly to the longitudinal direction of the rail, and in the z-axis extending in vertical direction, it is possible to register both an upper rail edge (SOK) for the vertical position as well as an inner rail edge (SIK) for a versine (see FIG. 6). The latter is composed of a transverse displacement path q (resulting from the transverse displacement relative to the machine frame 3) and a distance a defined by the transverse motion of the mirror 20. The upper rail edge (SOK) results from the shortest vertical distance h with reference to the rail 4.

Figure 7:
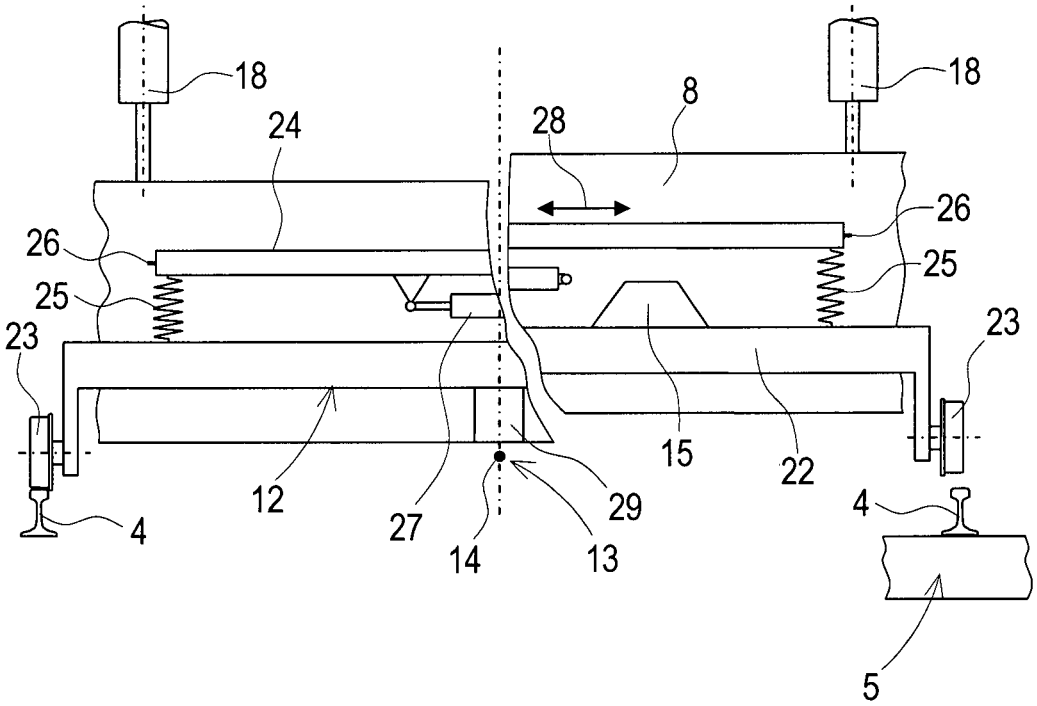
FIG. 7 shows a schematic representation of a further design variant.

The further variant, pictured in FIG. 7 in the longitudinal direction of the machine, of a central track position measuring unit 12 positioned between the two outer track position measuring units (12) has two track tracing rollers 23 connected to one another by a measuring base 22. Arranged between the measuring base 22 and a sliding carriage 24 are two coil springs 25, enabling a slight vertical displacement between the measuring base 22 and the sliding carriage 24 or the track lifting- and lining unit 8 connected thereto. The sliding carriage 24 is mounted in a transverse guide 26, connected to the track lifting- and lining unit 8, for transverse displacement by means of a drive 27 in a transverse direction 28 extending perpendicularly to the longitudinal direction of the machine.

Arranged on the measuring base 22 of the central track position measuring unit 12 is a measuring transducer 29 for simultaneously determining both a longitudinal level as well as a versine. This measuring transducer 29 has a contact member, not further shown, for contacting the measuring chord 14 situated between the rails 4 and serving as reference base 13. The measuring base 22 is connected to an inclinometer 15 for detecting the transverse track position.

Prior to working operations of the track maintenance machine 1 shown in FIG. 1, the track lifting- and lining unit 8 together with the central track position measuring unit 12 is in a raised position (shown in the right-hand half of the picture in FIG. 7). In this position, the two merely schematically indicated coil springs 25 are maximally relaxed.

By lowering the track lifting- and lining unit 8 onto the two rails 4, the two track tracing rollers 23 are automatically placed upon the rails 4, whereby the two coil springs 25 are compressed (see left-hand half of the picture in FIG. 7). In this manner, it is ensured that the track tracing rollers 23 are resting fully on the rails 4 even if the track rollers of the track lifting- and lining unit 8 should lift off slightly during working operations. Also, with this supporting, a contacting of the measuring chord 14 by the already mentioned contact member of the measuring transducer 29 takes place automatically.

In further sequence, the drive 27 is actuated for a slight transverse displacement of the entire track position measuring unit 12 relative to the track lifting- and lining unit 8 in order to press it against the rail 4 selected as reference rail.

After finishing working operations, along with lifting the track lifting- and lining unit 8, the central track position measuring unit 12 connected thereto is automatically also lifted, whereby the two coil springs 25 are relaxed again.

The invention claimed is:

1. A track maintenance machine for carrying out track position corrections, the track maintenance machine comprising:

on-track undercarriages to be disposed on rails of a track;

a machine frame being movable by said on-track undercarriages and having a track lifting and lining unit;

a track position measuring system including track position measuring units each registering a track position, said track position measuring units following one another in a longitudinal direction of the track maintenance machine; and a reference base at which all of said track position measuring units are disposed, said reference base being formed of a single measuring chord to be disposed centrally between the rails and extending in the longitudinal direction of the track maintenance machine; and said track position measuring units including a central track position measuring unit having two track tracing rollers and a measuring base interconnecting said two track tracing rollers;

said two track tracing rollers being adjustable in height together with said measuring base and a measuring transducer disposed on said central track position measuring unit relative to said track lifting and lining unit and relative to a vertical.

2. The track maintenance machine according to claim 1, wherein each of said track position measuring units has two laser scanners each being associated with a respective one of the rails for rail scanning in a horizontal y-axis extending perpendicularly to a longitudinal direction of the rail and in a z-axis extending in vertical direction.

3. The track maintenance machine according to claim 1, wherein:

said track position measuring units include two outer track position measuring units and said central track position measuring unit located between said two outer track position measuring units; and said measuring transducer contacts said measuring chord for determining both a longitudinal level and a versine.

4. The track maintenance machine according to claim 1, which further comprises a drive, said measuring base together with said track tracing rollers and said measuring transducer being mounted for transverse displacement by said drive perpendicularly to the longitudinal direction of the track maintenance machine relative to said track lifting and lining unit.

5. The track maintenance machine according to claim 1, wherein:

said track position measuring units include two outer track position measuring units and said central track position measuring unit; and an inclinometer is disposed on said central track position measuring unit for detecting a transverse level of the track.

* * * * *